US011395383B2

(12) United States Patent
Li et al.

(10) Patent No.: US 11,395,383 B2
(45) Date of Patent: Jul. 19, 2022

(54) LIGHTING DEVICE AND LIGHTING CONTROL SYSTEM THEREOF

(71) Applicants: ZHEJIANG YANKON MEGA LIGHTING CO., LTD., Zhejiang (CN); ZHEJIANG YANKON GROUP. CO., LTD., Zhejiang (CN)

(72) Inventors: Yang Li, Zhejiang (CN); Lingxiang Zhong, Zhejiang (CN); Qi Jiang, Zhejiang (CN); Bin Shen, Zhejiang (CN)

(73) Assignee: ZHEJIANG YANKON MEGA LIGHTING CO., LTD., Zhejiang (CN)

( * ) Notice: Subject to any disclaimer, the term of this patent is extended or adjusted under 35 U.S.C. 154(b) by 198 days.

(21) Appl. No.: 16/642,363

(22) PCT Filed: Jan. 22, 2020

(86) PCT No.: PCT/CN2020/073722

§ 371 (c)(1),
(2) Date: Feb. 26, 2020

(87) PCT Pub. No.: WO2021/146984

PCT Pub. Date: Jul. 29, 2021

(65) Prior Publication Data

US 2021/0410245 A1 Dec. 30, 2021

(51) Int. Cl.
*H05B 45/14* (2020.01)
*H05B 47/19* (2020.01)
*H05B 45/24* (2020.01)

(52) U.S. Cl.
CPC ..... *H05B 45/14* (2020.01); *H05B 45/24* (2020.01); *H05B 47/19* (2020.01)

(58) Field of Classification Search
CPC ..... H05B 45/00; H05B 45/10; H05B 45/20; H05B 45/3725; H05B 47/10; H05B 47/11;

(Continued)

(56) References Cited

U.S. PATENT DOCUMENTS 8,115,419 B2 * 2/2012 Given ..... H05B 45/375 315/307
8,872,437 B2 * 10/2014 Esaki ..... H05B 45/375 315/224

(Continued)

FOREIGN PATENT DOCUMENTS

CN 205726513 U 11/2016
CN 208369901 U 1/2019

(Continued)

OTHER PUBLICATIONS

International Search Report and Written Opinion of the International Searching Authority dated Nov. 2, 2020 for PCT/CN2020/073722.

*Primary Examiner* — Haissa Philogene
(74) *Attorney, Agent, or Firm* — Yue (Robert) Xu

(57) ABSTRACT

A lighting control system, including a TRIAC dimmer, a wireless control apparatus, and a lighting apparatus. The lighting apparatus includes a rectifier circuit, a TRIAC dimming detection circuit, a dimming constant-current circuit, and a controller connected to the TRIAC dimming detection circuit and the dimming constant-current circuit. The controller is configured to, control the dimming constant-current circuit to perform dimming on the lighting load based on a brightness control signal, in response to receiving the brightness control signal sent by the wireless control apparatus, and control the dimming constant-current circuit to restore a default state to stop the wireless control apparatus from limiting the dimming constant-current circuit, in response to the TRIAC dimming detection circuit determining that a first preset operation is performed on the TRIAC dimmer.

8 Claims, 3 Drawing Sheets

(58) Field of Classification Search
CPC ..... H05B 47/16; H05B 47/19; H05B 47/105; H05B 47/175; H05B 41/3925; H05B 41/3927; H05B 45/14; H05B 45/24; H05B 45/31; H05B 45/327; H05B 45/345; H05B 45/375; H05B 41/38; H05B 41/3924; Y02B 10/70; Y02B 20/30; Y02B 20/40; F21V 23/0442
See application file for complete search history.

(56) References Cited

U.S. PATENT DOCUMENTS

| | | | | |
|---|---|---|---|---|
| 9,214,456 | B2 * | 12/2015 | Doan | H01L 25/167 |
| 9,686,834 | B2 * | 6/2017 | Wang | H05B 45/3725 |
| 10,827,590 | B2 * | 11/2020 | Chen | H03K 17/56 |
| 11,013,081 | B1 * | 5/2021 | Yang | H05B 47/20 |
| 2011/0069960 | A1 * | 3/2011 | Knapp | H04L 12/437 398/103 |
| 2011/0133655 | A1 * | 6/2011 | Recker | H02H 3/08 315/159 |
| 2019/0098725 | A1 * | 3/2019 | Sadwick | H05B 45/20 |

FOREIGN PATENT DOCUMENTS

| | | | |
|---|---|---|---|
| CN | 110099489 | A | 8/2019 |
| CN | 110519902 | A | 11/2019 |
| CN | 110621101 | A | 12/2019 |
| KR | 20180061494 | A | 6/2018 |

* cited by examiner

LIGHTING DEVICE AND LIGHTING CONTROL SYSTEM THEREOF

This application is the national phase of International Application No. PCT/CN2020/073722, titled "LIGHTING DEVICE AND LIGHTING CONTROL SYSTEM THEREOF", filed on Jan. 20, 2020, the disclosures of which are incorporated herein by reference in its entirety.

TECHNICAL FIELD

The present disclosure relates to the technical field of lighting, and in particular to a lighting device and a lighting control system of the lighting device.

BACKGROUND

TRIAC dimmers are commonly used in some families to dim lighting products. Wireless communication technology and internet technology are also gradually applied to lighting products with rapid development. A current lighting product may be switched, dimmed, and toned wirelessly. In recent years, some lighting products can apply both the TRIAC dimmer for dimming and a wireless control apparatus for dimming and toning, due to technology development. In practice, there are some problems in such lighting products.

Specifically, a user may dim a lighting product via the wireless apparatus to a middle or low level in brightness, and then dim the lighting product again via a conventional TRIAC dimmer. In such case, a dimming range for the TRIAC dimmer is quite narrow, and thereby the product cannot be dimmed through a whole dimming range. Namely, the TRIAC dimmer cannot perform dimming on the lighting product to high brightness. Especially, such two problems are apt to occur in a family with both the youth and the elder. The elder is used to dimming via the conventional TRIAC dimmer, while the youth prefers smart dimming through wireless control.

Therefore, an urgent technical problem to be solved by those skilled in the art is how to effectively dim a lighting product while avoiding the above problems.

SUMMARY

In order to address the above technical issue in conventional technology, a lighting device and a lighting control system of the lighting device are provided according to embodiments of the present disclosure.

A technical solution is provided as follows according to an embodiment of the present disclosure, so as to address the above technical issue. A lighting control system is provided, including:

a TRIAC dimmer, arranged on a power supply line of a lighting apparatus, where the TRIAC dimmer is configured to perform dimming on a lighting load;

a wireless control apparatus; and the lighting apparatus, connected to the wireless control apparatus and the TRIAC dimmer, where the lighting apparatus includes:

a rectifier circuit, connected to the TRIAC dimmer, where the rectifier circuit is configured to receive an alternating-current input;

a dimming constant-current circuit, connected to the rectifier circuit and the lighting load;

a TRIAC dimming detection circuit; and a controller, connected to the TRIAC dimming detection circuit and the dimming constant-current circuit, where the controller is configured to control the dimming constant-current circuit to perform dimming on the lighting load based on a brightness control signal, in response to receiving the brightness control signal sent by the wireless control apparatus, and control the dimming constant-current circuit to restore a default state to stop the wireless control apparatus from limiting the dimming constant-current circuit, in response to the TRIAC dimming detection circuit determining that a first preset operation is performed on the TRIAC dimmer.

In one embodiment, the lighting control system further includes a current detection circuit, configured to detect a current flowing through the lighting load, where:

the controller is further configured to transmit wirelessly a value of the current detected by the current detection circuit to the wireless control apparatus; and the wireless control apparatus is further configured to display the received value of the current.

In one embodiment, the lighting control system further includes a color-temperature adjustment circuit connected to the lighting load and the controller, where:

the controller is further configured to control the color-temperature adjustment circuit based on a color-temperature control signal to adjust a color temperature of the lighting load, in response to receiving the color-temperature control signal sent by the wireless control apparatus.

In one embodiment, the controller is further configured to control the color-temperature adjustment circuit according to a predetermined color-temperature control strategy, to adjust the color temperature of the lighting load, in response to the TRIAC dimming detection circuit determining that a second preset operation is performed on the TRIAC dimmer.

In one embodiment, the controller is further configured to send the color temperature of the lighting load to the wireless control apparatus, to display the color temperature of the lighting load by the wireless control apparatus.

In one embodiment, the TRIAC dimming detection circuit is a voltage detection circuit connected to the rectifier circuit, where the voltage detection circuit is configured to detect a voltage outputted by the rectifier circuit, and where the voltage detection circuit determines that the first preset operation is performed on the TRIAC dimmer, in response to a change in the voltage detected by the voltage detection circuit following a predetermined first variation; and the voltage detection circuit determines that the second preset operation is performed on the TRIAC dimmer, in response to a change in the voltage detected by the voltage detection circuit following a predetermined second variation.

In one embodiment, the lighting control system further includes a bleeder circuit connected in parallel with the dimming constant-current circuit, where the bleeder circuit is configured to provide a sustaining current.

In one embodiment, the dimming constant-current circuit is configured to perform dimming through analog dimming.

In one embodiment, the controller performs dimming in a stepwise manner to make brightness of the lighting load reach a value of brightness carried in the brightness control signal, in controlling the dimming constant-current circuit based on the brightness control signal to perform dimming on the lighting load.

A lighting device is provided, including any of the aforementioned lighting control systems.

It is found from analysis that for a conventional lighting product, a brightness value displayed by a wireless control apparatus cannot truly reflect current actual brightness, when a user dims brightness to a middle or low level via a TRIAC dimmer and then dims via the wireless control apparatus. The reason is that a conventional wireless control apparatus assumes that a voltage of a previous stage is within a normal range. When dimming has been performed by the TRIAC dimmer and the brightness is adjusted to a middle or low level, an output voltage of the rectifier circuit is much lower than the normal range, and thereby the brightness value displayed by the conventional wireless control apparatus is much higher than actual brightness. According to an embodiment of the present disclosure, the current detection circuit 40 is provided to detect the current flowing through the lighting load, the controller 60 may transmit wirelessly the value of the current detected by the current detection circuit 40 to a wireless control apparatus 70, and the wireless control apparatus 70 may display the received value of the current. Since the current flowing through the lighting load can reflect the brightness of the lighting load directly and accurately, the wireless control apparatus 70 can truly reflect the current actual brightness of the lighting load according to an embodiment of the present disclosure.

It is further found that a dimming range for the TRIAC dimmer is quite narrow in the conventional lighting product, when the user dims brightness of the lighting product to a middle or low level via the conventional wireless control apparatus, and then dims via the conventional TRIAC dimmer. Thus, the TRIAC dimmer cannot perform dimming on the product through a whole dimming range. The reason is that the conventional wireless control apparatus controls a relevant dimming circuit in the product, so that power on the load is limited. According to an embodiment of the present disclosure, the TRIAC dimming detection circuit 50 is provided according to the present disclosure. In a case that the TRIAC dimming detection circuit 50 determines that a first preset operation is performed on a TRIAC dimmer 10, it is indicated that the user performs the predetermined first preset operation on the TRIAC dimmer 10. In such case, the controller 60 controls the dimming constant-current circuit 30 to restore the default state, so as to stop wireless control apparatus 70 from limiting the dimming constant-current circuit 30. Therefore, according to an embodiment of the present disclosure, the product can still be dimmed via the TRIAC dimmer 10 through the whole dimming range, after the brightness is dimmed via the wireless control apparatus 70 to the middle or low level.

DETAILED DESCRIPTION

A key of the present disclosure is a lighting control system. Current actual brightness of a lighting load can still be truly reflected by a wireless control apparatus 70, when brightness is dimmed the wireless control apparatus 70 after being dimmed to a middle or low level via a TRIAC dimmer. Moreover, the whole lighting product can still be adjusted within a whole dimming range via the TRIAC dimmer 10, after brightness thereof is dimmed to a middle or low level via the wireless control apparatus 70.

To make the object, technical solutions and advantages of the present disclosure clearer, hereinafter technical solutions in embodiments of the present disclosure are described clearly and completely in conjunction with the drawings in embodiments of the present closure. Apparently, the described embodiments are only some rather than all of the embodiments of the present disclosure. Any other embodiments obtained based on the embodiments of the present disclosure by those skilled in the art without any creative effort fall within the scope of protection of the present disclosure.

Figure 1:
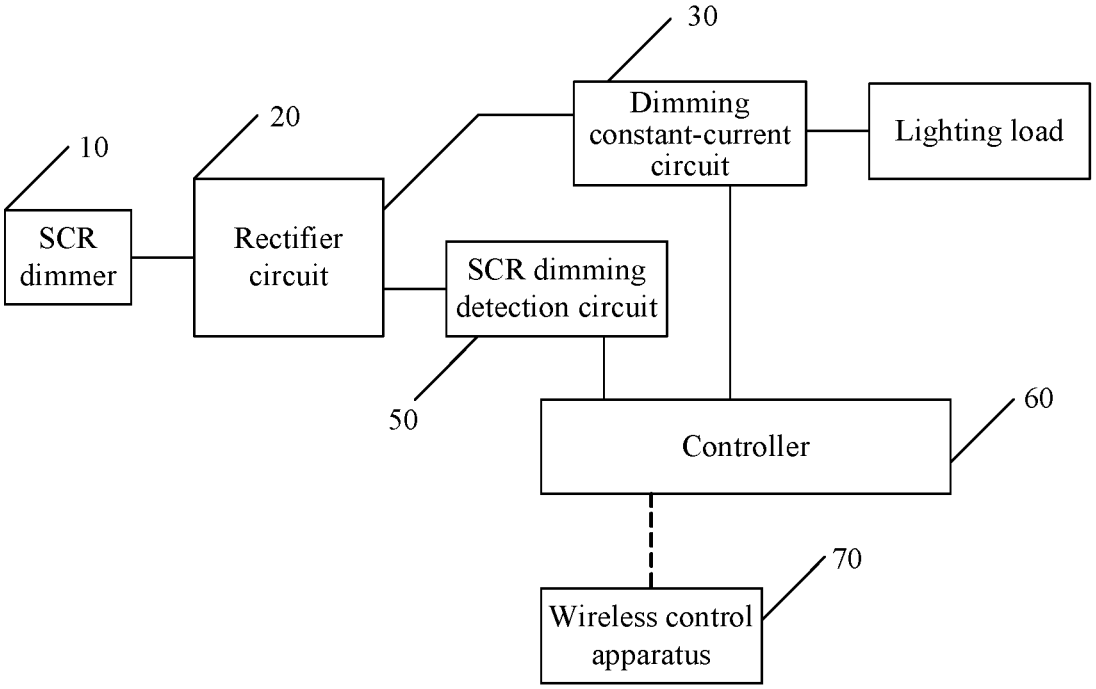
FIG. 1 is a schematic structural diagram of a lighting control system according to an embodiment of the present disclosure.

Reference is made to FIG. 1, which is a schematic structural diagram of a lighting control system according to an embodiment of the present disclosure. The lighting control system may include: a TRIAC dimmer 10, a wireless control apparatus 70, and a lighting apparatus.

The TRIAC dimmer 10 is arranged on a power supply line of the lighting apparatus, and is configured to perform dimming on a lighting load.

The lighting apparatus is connected to the wireless control apparatus 70 and the TRIAC dimmer 10. The lighting apparatus includes: a rectifier circuit 20, a dimming constant-current circuit 30, a TRIAC dimming detection circuit 50, and a controller 60.

The rectifier circuit 20 is connected to the TRIAC dimmer 10, and is configured to receive an alternating current input.

The dimming constant-current circuit 30 is connected to the rectifier circuit 20 and the lighting load.

The controller 60 is connected to the TRIAC dimming detection circuit 50 and the dimming constant-current circuit 30. The controller 60 is configured to control the dimming constant-current circuit 30 to perform dimming on the lighting load based on a brightness control signal, in response to receiving the brightness control signal sent by the wireless control apparatus 70. The controller 60 is further configured to control the dimming constant-current circuit 30 to restore a default state to stop the wireless control apparatus 70 from limiting the dimming constant-current circuit 30, in response to the TRIAC dimming detection circuit 50 determining that a first preset operation is performed on the TRIAC dimmer 10.

Specifically, the TRIAC dimmer 10 may adjust a phase angle of a voltage, that is, control a conduction angle. It is understood that a larger conduction angle indicates a higher voltage at an output terminal of the rectifier circuit 20.

The TRIAC dimmer 10 is usually arranged on a live line. The TRIAC dimmer 10 is commonly installed in houses, especially in some developed countries.

Figure 2:
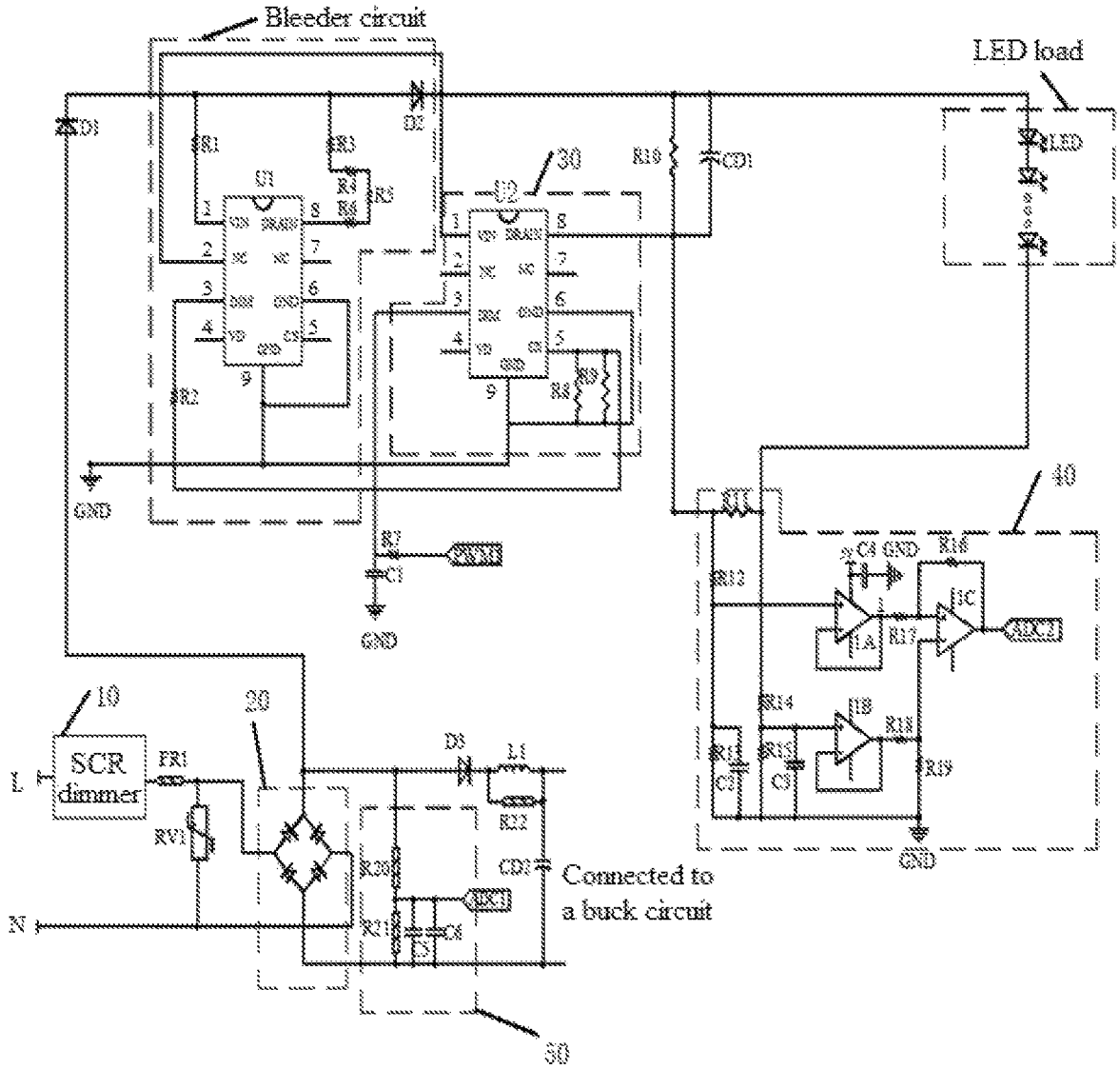
FIG. 2 is a schematic structural diagram of a lighting control system according to a specific embodiment of the present disclosure.

The rectifier circuit 20 is connected to the TRIAC dimmer 10, and may rectify a received alternating-current input. A circuit configuration of the rectifier circuit 20 may depend on practical situation. For example, the rectifier circuit 20 includes four diodes according to an embodiment as shown in FIG. 2. The circuit structure is simple and reliable, and it is unnecessary to control the included devices since all the devices are passive.

The dimming constant-current circuit 30 may receive an electric signal from the controller 60, so as to control the brightness of the lighting load based on information carried in the electric signal. The dimming constant-current circuit 30 may apply a manner of PWIVI dimming or analog dimming. In practice, the dimming constant-current circuit 30 usually apply the manner of analog dimming, which is advantageous in avoiding flickering of the lighting load during dimming.

Further, the lighting control system may further include a bleeder circuit according to an embodiment of the present disclosure. The bleeder circuit is connected in parallel with the dimming constant-current circuit 30, and is configured to provide a sustaining current.

In this embodiment, the TRIAC dimmer 10 may be used for dimming according to the present disclosure, and a user may adjust the brightness of the lighting load to be very low via the TRIAC dimmer 10. In such case, the lighting load flickers in a case that a current in a loop is lower than a minimum operating current of the TRIAC dimmer 10. In view of the above, the bleeder circuit is provided, which is connected in parallel with the dimming constant-current circuit 30 and is configured to provide the sustaining current. The bleeder circuit may provide the sustaining current to the TRIAC dimmer 10, thereby avoiding flickering of the lighting load during dimming via the TRIAC dimmer 10.

Specific circuit configuration of the bleeder circuit may depend on a practical situation. The bleeder circuit may be active or passive. A schematic structural diagram of a bleeder circuit is shown in FIG. 2, as an embodiment for a specific situation.

The controller 60 controls the dimming constant-current circuit 30 based on the brightness control signal, so as to perform dimming on the lighting load, in response to receiving the brightness control signal sent by the wireless control apparatus 70. As an example, shown in FIG. 2, the controller 60 may send a PWM signal to a pin "DIM" of a chip U2 in the dimming constant-current circuit 30, and the chip U2 controls the lighting load correspondingly based on different signals received by the pin. It is appreciated that the controller 60 and the wireless control apparatus 70 are not shown in FIG. 2.

In practice, a voltage outputted by the rectifier circuit 20 may be stepped down for supplying power to the controller 60. For example, in an embodiment as shown in FIG. 2, an LC filter circuit is arranged as a post stage of the rectifier circuit 20, and the rectifier circuit 20 may be connected to a buck circuit via the LC filter circuit, so as to reduce the voltage to, for example, 5V or 3.3V. Thereby, the controller 60 and other active devices in the circuit are powered.

Figure 3:
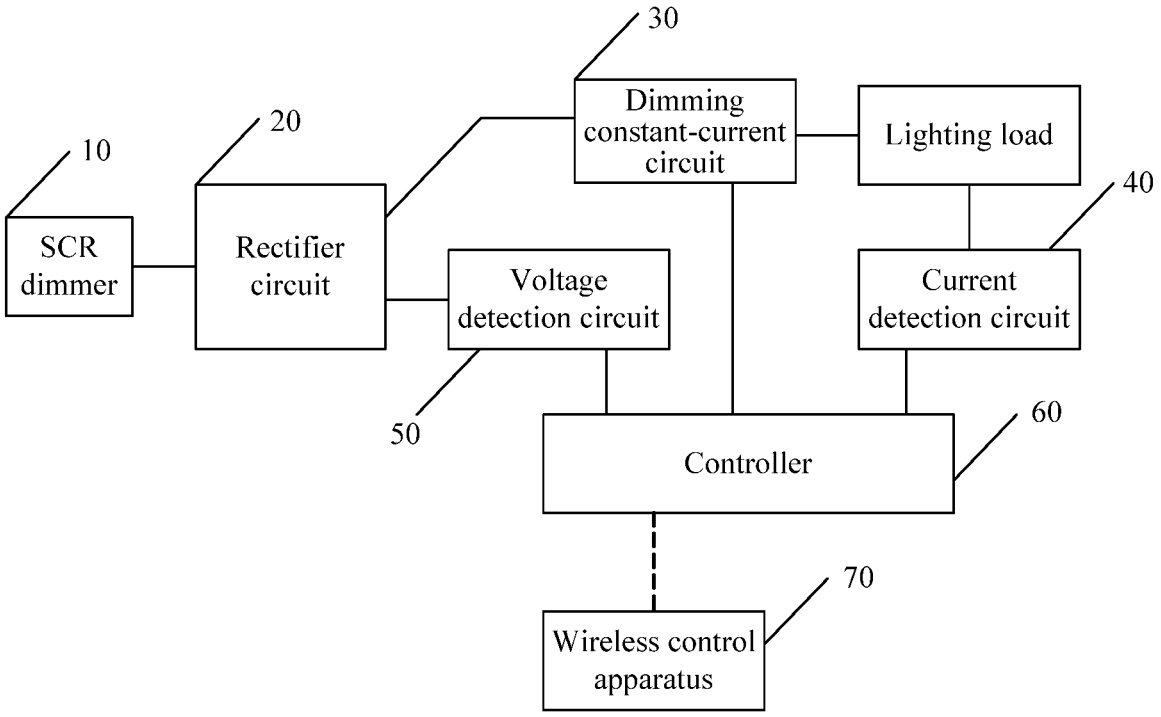
FIG. 3 is a schematic structural diagram of a lighting control system according to another embodiment of the present disclosure.

Reference is further made to FIG. 3. The lighting control system may further include a current detection circuit 40 according to an embodiment of the present disclosure.

The current detection circuit 40 is configured to detect a current flowing through the lighting load. The controller 60 is further configured to transmit wirelessly a value of the current detected by the current detection circuit 40 to the wireless control apparatus 70. The wireless control apparatus 70 is further configured to display the received value of the current.

In practice, it is found that during usage of a conventional lighting product, brightness of the lighting product is far lower than an expected brightness, in a case the user dims the lighting product via a conventional wireless control apparatus after firstly dimming brightness to a middle or low level via a conventional TRIAC dimmer. That is, a brightness value displayed by the conventional wireless control apparatus cannot truly reflect current actual brightness.

Moreover, it is found from analysis that for the conventional lighting product, the brightness value displayed by the wireless control apparatus cannot truly reflect current actual brightness, when the user dims brightness to the middle or low level via the TRIAC dimmer and then dims via the wireless control apparatus. The reason is that a conventional wireless control apparatus assumes that a voltage of a previous stage is within a normal range. When dimming has been performed by the TRIAC dimmer and the brightness is adjusted to the middle or low level, an output voltage of the rectifier circuit is much lower than the normal range, and thereby the brightness value displayed by the conventional wireless control apparatus is much higher than actual brightness.

Therefore, according to an embodiment of the present disclosure, the current detection circuit 40 is provided to detect the current flowing through the lighting load, the controller 60 may transmit wirelessly the value of the current detected by the current detection circuit 40 to the wireless control apparatus 70, and the wireless control apparatus 70 may display the received value of the current. Since the current flowing through the lighting load can reflect the brightness of the lighting load directly and accurately, the wireless control apparatus 70 can truly reflect the current actual brightness of the lighting load according to an embodiment of the present disclosure.

In practice, for a specific lighting load, a correspondence between the current flowing through the lighting load and the brightness of the lighting load may be predetermined. Therefore, besides displaying the value of the current, the wireless control apparatus 70 may further determine a brightness value corresponding to the currently displayed value of the current, and display the brightness value to the user, so as to facilitate the user learning about current brightness. Thereby, it is convenient and intuitive for the user to obtain the current brightness of the lighting load.

The wireless control apparatus 70 according to an embodiment the present disclosure may be a wireless control apparatus 70 that is specially configured. In some embodiments, the wireless control apparatus 70 may be a mobile phone or a tablet computer which the user often carries, so as to reduce a cost. The mobile phone or the tablet computer can achieve a function of the wireless control apparatus 70 according to an embodiment of the present disclosure, by installing a certain APP on the mobile phone or the tablet computer. Mobile devices are convenient to carry.

It should be noted that Bluetooth may be commonly used as a communication manner, in a case that the mobile phone or the tablet computer serves as the wireless control apparatus 70. In some embodiments, the wireless control apparatus 70 may include a mobile phone or a tablet computer, and a cloud device, in a case that the user wishes to use other wireless communication manners such as Wifi. For example, the mobile phone communicates through Wifi with a cloud, and the cloud is connected through Wifi to the lighting apparatus. That is, the cloud communicates through Wifi with the controller 60 in the lighting apparatus.

For example, the mobile phone displays that the dimming constant-current circuit 30 is currently adjusted to a level of 70%, the current brightness of the lighting load is 350 mcd, and the value of the current is A. The user adjusts the dimming constant-current circuit 30 to a level of 80% by tapping a button of certain software installed in the mobile phone. In such case, the mobile phone displays that the current brightness of the lighting load reaches 420 mcd, and the value of the current is B.

It should be noted that both the dimming constant-current circuit 30 and the TRIAC dimmer 10 is capable to perform dimming on the lighting load. Therefore, the lighting load may not be adjusted to a brightest level when dimming is performed by the wireless control apparatus 70. For example, the user operates on the mobile phone to adjust the dimming constant-current circuit 30 to a level of 100%. Accordingly, the mobile phone sends information that the dimming constant-current circuit 30 is adjusted to the level of 100% to the controller 60. After the controller 60 completes dimming via the dimming constant-current circuit 30, the mobile phone displays that the current actual brightness is 550 mcd, but does not reach a brightest level of 600 mcd. In such case, it may indicate that the TRIAC dimmer 10 has limited the voltage in a previous step. In a case that the user wants the brightness of the lighting load to reach 600 mcd, the user is required to operate the TRIAC dimmer 10 manually. It can be seen that according to a solution of the present disclosure, the current brightness can be truly and accurately reflected on the mobile phone based on the value of the current flowing through the lighting load, after the user adjusts the dimming constant-current circuit 30 to the level of 100% via the mobile phone. For example, in the aforementioned embodiment, the mobile phone displays the true current actual brightness of 550 mcd, instead of wrong brightness of 600 mcd, after the dimming constant-current circuit 30 is adjusted to the level of 100%.

In this embodiment, adjusting the dimming constant-current circuit 30 to a level of 70%, 80%, and 100% refers to the dimming constant-current circuit 30 controlling a degree of dimming. In a case that other conditions are same, a higher value indicates that the lighting load is controlled to be brighter by the dimming constant-current circuit 30. It is appreciated that under same conditions, the brightness of the lighting load is maximum when the dimming constant-current circuit 30 is adjusted to a highest level, that is, the dimming constant-current circuit 30 is adjusted to the level of 100%.

In a case that the TRIAC dimming detection circuit 50 determines that a first preset operation is performed on the TRIAC dimmer 10, the controller 60 controls the dimming constant-current circuit 30 to restore a default state to stop the wireless control apparatus 70 from limiting the dimming constant-current circuit 30, according to an embodiment of the present disclosure.

A specific form of the TRIAC dimming detection circuit 50 may depend on a practical situation. Generally, the TRIAC dimming detection circuit 50 may be a voltage detection circuit 50. As shown in FIG. 3, the voltage detection circuit 50 is selected as the TRIAC dimming detection circuit 50.

In an embodiment of the present disclosure, the TRIAC dimming detection circuit 50 is connected to the rectifier circuit 20, and is configured to detect a voltage outputted by the rectifier circuit 20. In this embodiment, in a case that a change in the voltage detected by the voltage detection circuit 50 follows a predetermined first variation, the voltage detection circuit 50 determines that the first preset operation is performed on the TRIAC dimmer 10.

The change in the voltage detected by the voltage detection circuit 50 follows a predetermined first variation, which indicates that the user performs a predetermined operation. It should be noted that the change in the voltage detected by the voltage detection circuit 50 may include a change in amplitude of the voltage and/or a change in a phase of the voltage. The amplitude is taken as an example. In a specific situation, the user adjusts the TRIAC dimmer 10 to a maximum level, and then to a minimum level, and the voltage detected by the voltage detection circuit 50 increases to maximum and then decrease to minimum during such process. Thereby, the controller 60 may determine that the change in the voltage detected by the voltage detection circuit 50 follows the predetermined first variation. It can be understood that in practice, the change in the voltage is not required to be exactly coincident with the predetermined first variation for following the predetermined first variation, since an error in detection is considered. For example, the predetermined operation in this example is that the user adjusts the TRIAC dimmer 10 to the maximum level and then to the minimum level, and the controller 60 may determine that the change in the voltage follows the predetermined first variation, as long as the voltage detected by the voltage detection circuit 50 is higher than a preset upper threshold, and then decreases to be lower than a preset lower threshold value within a predetermined first time period. It is appreciated there may be more complicated and accurate manners for determining whether the change in the voltage follows the predetermined first variation in other situations, and such manners may be configured and selected according to a practical requirement, which does not affect implementation of the present disclosure.

It is appreciated that other specific forms besides the voltage detection circuit 50 may be selected as the TRIAC dimming detection circuit 50, as long as the first preset operation performed by the user on the TRIAC dimmer 10 can be detected.

The TRIAC dimming detection circuit 50 determines that the first preset operation is performed on the TRIAC dimmer 10, which indicates that the user needs to use the TRIAC dimmer 10 for dimming. Therefore, the controller 60 controls the dimming constant-current circuit 30 to restore a default state according to a solution of the present disclosure, to stop the wireless control apparatus 70 from limiting the dimming constant-current circuit 30, thereby enabling the TRIAC dimmer 10 to perform dimming through the whole dimming range.

For example, in a family, the youth adjusts the dimming constant-current circuit 30 to a level of 20% via a wireless control apparatus 70, such as a mobile phone, before the elder uses the TRIAC dimmer 10. In a case that the limitation put by the wireless control apparatus 70 on the dimming constant-current circuit 30 is not suspended, the brightness of the lighting load is still low even if the TRIAC dimmer 10 is adjusted to the maximum level. The TRIAC dimmer 10 is capable to perform dimming through the whole dimming range after the controller 60 controls the dimming constant-current circuit 30 to restore the default state, for example, controls the dimming constant-current circuit 30 to restore the level of 100%.

The default state of the dimming constant-current circuit 30 refers to a state in which the dimming constant-current circuit 30 controls dimming of the lighting load with a degree higher than a preset threshold. Generally, the dimming constant-current circuit 30 performs dimming at a level of 100% in the default state, that is, the preset threshold is usually the level of 100%. It is appreciated that another value other than the level of 100%, such as a level of 90%, may be selected as the default state according to a practical requirement in another situation. It should be noted that such value should not be too low, in order to prevent that the user cannot adjust the lighting load bright enough via the TRIAC dimmer 10.

According to an embodiment of the present disclosure, the lighting control system may further include a color-temperature adjustment circuit connected to the lighting load and the controller 60. The controller 60 is further configured to control the color-temperature adjustment circuit based on a color-temperature control signal, so as to adjust a color temperature of the lighting load, in response to receiving the color-temperature control signal sent by the wireless control apparatus 70.

Besides dimming, the color-temperature adjustment circuit may be provided in the lighting control system according to an embodiment the present disclosure. The controller 60 may control the color-temperature adjustment circuit based on information carried in the color-temperature control signal, in response to receiving the color-temperature control signal sent by the wireless control apparatus 70. Thereby, the color temperature of the lighting load is adjusted. It can be appreciated that the lighting load has at least two color temperatures, since the color temperature is required to be adjusted according to this embodiment.

Generally, the lighting load may be an LED lamp. According to an embodiment of the present disclosure, the lighting load may include a single LED lamp, or a combination of multiple LED lamps connected in series or parallel, which does not affect the implementation of the present disclosure. FIG. 2 shows an embodiment in which the lighting load is an LED load including multiple LED lamps connected in series.

In order to enable the user to learn about a current color temperature intuitively and accurately, the controller 60 may further be configured to send a color temperature of the lighting load to the wireless control apparatus 70, so that the wireless control apparatus 70 displays the color temperature of the lighting load.

In the above embodiment, the user may control the color temperature wirelessly.

According to another embodiment of the present disclosure, the user may adjust the color temperature via the TRIAC dimmer 10. Specifically, the controller 60 is further configured to control the color-temperature adjustment circuit according to a predetermined color-temperature control strategy, so as to adjust the color temperature of the lighting load, in response to the TRIAC dimming detection circuit 50 determining that a second preset operation is performed on the TRIAC dimmer 10.

It is further taken as an example of description that the voltage detection circuit 50 is selected as the TRIAC dimming detection circuit 50. In an embodiment, the voltage detection circuit 50 determines that a second preset operation is performed on the TRIAC dimmer 10, in response to the change in the voltage detected by the voltage detection circuit 50 following a predetermined second variation.

For example, the predetermined operation is that the user adjusts the TRIAC dimmer 10 twice from the maximum level to the minimum level, for adjusting the color temperature via the TRIAC dimmer 10. The voltage detection circuit 50 may determine that the user performs the predetermined operation for adjusting color temperature via the TRIAC dimmer 10, that is, performs the second preset operation, when the controller 60 determines that the change in the voltage detected by the voltage detection circuit 50 follows the predetermined second variation. In such case, the controller 60 controls the color-temperature adjustment circuit according to the predetermined color-temperature control strategy. The predetermined color-temperature control strategy may be set and adjusted on requirement. For example, four different levels of color temperature, i.e. level 1, level 2, level 3, and level 4, are preset. Each time the user performs the predetermined operation for adjusting color temperature, the controller 60 controls the color-temperature adjustment circuit to increase the color temperature of the lighting load by one level. It is appreciated that the adjustment goes to level 1 in case of level 4.

According to an embodiment of the present disclosure, the controller 60 performs dimming in a stepwise manner, in controlling the dimming constant-current circuit 30 based on the brightness control signal to perform dimming on the lighting load, so as to make brightness of the lighting load reach the value of brightness carried in the brightness control signal.

In practice, the wireless control apparatus 70 may support multiple kinds of inputting from the user for convenience in usage. For example, the user may control the dimming constant-current circuit 30 ranging from a level from 0 to 100%, so as to achieve dimming. For example, the user wants to adjust the dimming constant-current circuit 30 to a level of 40%. In such case, it is only required that the wireless control apparatus 70 sends information to the controller 60, and the dimming constant-current circuit 30 is controlled and adjusted to the level 40%.

In some cases, the user may directly input a value of brightness, or directly inputs a ratio of a required brightness to the maximum brightness. The brightness of the lighting load is controlled by the dimming constant-current circuit 30 and the TRIAC dimmer 10 according to an embodiment of the present disclosure. As one solution, it is required that the controller 60 obtains a current limitation put by the TRIAC dimmer 10 on the voltage, and thereby determines how to adjust the dimming constant-current circuit 30, so as to adjust the brightness of the lighting load to the value of brightness required by the user. Such solution is complicated. Therefore, the controller 60 is configured to perform adjustment in the stepwise manner according to an embodiment, so as to adjust the brightness of the lighting load to the value of brightness carried in the brightness control signal.

Specifically, a target value of a current flowing through the lighting load, which corresponds to a desired value of brightness, can be determined after such value of brightness is inputted by the user. In such case, it is only required to perform adjustment in the stepwise manner. That is, the controller 60 adjusts the dimming constant-current circuit 30 by a small step each time, and then determines whether the current flowing through the load reaches the target value of the current. The current flowing through the lighting load can reach the target value of the current after multiple such adjustments.

It is found from analysis that for a conventional lighting product, a brightness value displayed by a wireless control apparatus cannot truly reflect current actual brightness, when a user dims brightness to a middle or low level via a TRIAC dimmer and then dims via the wireless control apparatus. The reason is that a conventional wireless control apparatus assumes that a voltage of a previous stage is within a normal range. When dimming has been performed by the TRIAC dimmer and the brightness is adjusted to a middle or low level, an output voltage of the rectifier circuit is much lower than the normal range, and thereby the brightness value displayed by the conventional wireless control apparatus is much higher than actual brightness. According to an embodiment of the present disclosure, the current detection circuit 40 is provided to detect the current flowing through the lighting load, the controller 60 may transmit wirelessly the value of the current detected by the current detection circuit 40 to a wireless control apparatus 70, and the wireless control apparatus 70 may display the received value of the current. Since the current flowing through the lighting load can reflect the brightness of the lighting load directly and accurately, the wireless control apparatus 70 can truly reflect the current actual brightness of the lighting load according to an embodiment of the present disclosure.

It is further found that a dimming range for the TRIAC dimmer is quite narrow in the conventional lighting product, when the user dims brightness of the lighting product to a middle or low level via the conventional wireless control apparatus, and then dims via the conventional TRIAC dimmer. Thus, the TRIAC dimmer cannot perform dimming on the product through a whole dimming range. The reason is that the conventional wireless control apparatus controls a relevant dimming circuit in the product, so that power on the load is limited. According to an embodiment of the present disclosure, the TRIAC dimming detection circuit 50 is provided according to the present disclosure. In a case that the TRIAC dimming detection circuit 50 determines that a first preset operation is performed on a TRIAC dimmer 10, it is indicated that the user performs the predetermined first preset operation on the TRIAC dimmer 10. In such case, the controller 60 controls the dimming constant-current circuit 30 to restore a default state, so as to stop wireless control apparatus 70 from limiting the dimming constant-current circuit 30. Therefore, according to an embodiment of the present disclosure, the product can still be dimmed via the TRIAC dimmer 10 through the whole dimming range, after the brightness is dimmed via the wireless control apparatus 70 to the middle or low level.

A lighting device is further provided according to an embodiment of the present disclosure, which corresponds to the above embodiments of the lighting control system. The lighting device may refer to the above description correspondingly, and is not be repeated herein.

As further be appreciated by those skilled in the art, the units and algorithmic steps in the examples described according to the embodiments disclosed herein can be implemented in forms of electronic hardware, computer software or the combination of the both. To illustrate the interchangeability of the hardware and the software clearly, the components and the steps in the examples are described generally according to functions in the above description. Whether hardware or software is used to implement the functions depends on a specific application and design constraints for the technical solution. For each specific application, different methods may be used by those skilled in the art to implement the described function, and such implementation should not be considered to depart from the scope of the present disclosure.

Specific embodiments are used herein to illustrate the principle and implementation of the present disclosure. The illustration of the above embodiments is only intended to help understand the technical solution and concept of the present disclosure. It should be noted that various improvements and modifications can be made to the present disclosure by those skilled in the art without departing from the principle of the present disclosure. These improvements and modifications also fall within the protection scope of the claims of the present disclosure.

The invention claimed is:

1. A lighting control system, comprising:

a silicon-controlled-rectifier (SCR) dimmer, arranged on a power supply line of a lighting apparatus, wherein the SCR dimmer is configured to perform dimming on a lighting load;

a wireless control apparatus;

the lighting apparatus, connected to the wireless control apparatus and the SCR dimmer, wherein the lighting apparatus comprises:

a rectifier circuit, connected to the SCR dimmer, wherein the rectifier circuit is configured to receive an alternating-current input;

a dimming constant-current circuit, connected to the rectifier circuit and the lighting load;

a SCR dimming detection circuit; and a controller, connected to a SCR dimming detection circuit and the dimming constant-current circuit, wherein the controller is configured to:

control the dimming constant-current circuit to perform dimming on the lighting load based on a brightness control signal, in response to receiving the brightness control signal sent by the wireless control apparatus, and control the dimming constant-current circuit to restore a default state to stop the wireless control apparatus from limiting the dimming constant-current circuit, in response to the SCR dimming detection circuit determining that a first preset operation is performed on the SCR dimmer; and a current detection circuit configured to detect a current flowing through the lighting load, wherein:

the controller is further configured to transmit wirelessly a value of the current detected by the current detection circuit to the wireless control apparatus; and the wireless control apparatus is further configured to display the received value of the current.

2. A lighting device, comprising the lighting control system according to claim 1.

3. The lighting control system according to claim 1, further comprising a color-temperature adjustment circuit connected to the lighting load and the controller, wherein:

the controller is further configured to control the color-temperature adjustment circuit based on a color-temperature control signal to adjust a color temperature of the lighting load, in response to receiving the color-temperature control signal sent by the wireless control apparatus.

4. The lighting control system according to claim 3, wherein the controller is further configured to control the color-temperature adjustment circuit according to a predetermined color-temperature control strategy, to adjust the color temperature of the lighting load, in response to the SCR dimming detection circuit determining that a second preset operation is performed on the SCR dimmer.

5. The lighting control system according to claim 3, wherein the controller is further configured to send the color temperature of the lighting load to the wireless control apparatus, to display the color temperature of the lighting load by the wireless control apparatus.

6. The lighting control system according to claim 4, wherein:

the SCR dimming detection circuit is a voltage detection circuit connected to the rectifier circuit;

the voltage detection circuit is configured to detect a voltage outputted by the rectifier circuit;

the voltage detection circuit determines that the first preset operation is performed on the SCR dimmer, in response to a change in the voltage detected by the voltage detection circuit following a predetermined first curve; and the voltage detection circuit determines that the second preset operation is performed on the SCR dimmer, in response to a change in the voltage detected by the voltage detection circuit following a predetermined second curve.

7. The lighting control system according to claim 1, further comprising a bleeder circuit connected in parallel with the dimming constant-current circuit, wherein the bleeder circuit is configured to provide a sustaining current.

8. The lighting control system according to claim 1, wherein the dimming constant-current circuit is configured to perform dimming through analog dimming.

* * * * *